US005602353A

United States Patent [19]

Juszkiewicz et al.

[11] Patent Number: 5,602,353

[45] Date of Patent: Feb. 11, 1997

[54] BRIDGE SADDLE WITH ADJUSTABLE INTONATION SYSTEM

[76] Inventors: Henry E. Juszkiewicz, 1050 Acorn Dr., Suite B, Nashville, Tenn. 37210; Timothy P. Shaw, 1341 Cheyenne Blvd., Madison, Tenn. 37115

[21] Appl. No.: 368,744

[22] Filed: Jan. 4, 1995

Related U.S. Application Data

[63] Continuation of Ser. No. 897,787, Jun. 12, 1992, abandoned.

[51] Int. Cl.[6] ..... G10D 3/04

[52] U.S. Cl. ..... 84/298; 84/731

[58] Field of Search ..... 84/293, 298, 299, 84/307, 730, 731

[56] References Cited

U.S. PATENT DOCUMENTS

| | | | |
|---|---|---|---|
| D. 269,438 | 6/1983 | Peavey | D17/21 |
| 294,832 | 3/1884 | Wichard . | |
| 490,528 | 1/1893 | Wooster . | |
| 688,272 | 12/1901 | Truax . | |
| 727,203 | 5/1903 | Roberts et al. . | |
| 934,678 | 9/1909 | Laurian . | |
| 1,889,408 | 11/1932 | Larson . | |
| 2,614,448 | 10/1952 | Maccaferri | 84/298 |
| 3,154,701 | 10/1964 | Evans | 310/9.6 |
| 3,174,380 | 3/1965 | Cookerly et al. | 84/307 |
| 3,538,233 | 11/1970 | Compton et al. | 84/1.16 |
| 3,605,545 | 9/1971 | Rendell | 84/307 |
| 3,712,951 | 1/1973 | Rickard | 84/1.14 |
| 3,911,777 | 10/1975 | Rendell | 84/1.16 |
| 3,971,286 | 7/1976 | Borell | 84/314 |
| 4,069,733 | 1/1978 | Quan | 84/299 |
| 4,128,033 | 12/1978 | Petillo | 84/299 |
| 4,135,426 | 1/1979 | Rickard | 84/1.16 |
| 4,160,401 | 7/1979 | Tomioka | 84/1.16 |
| 4,189,969 | 2/1980 | Katayama et al. | 84/1.14 |
| 4,208,941 | 6/1980 | Wechter | 84/298 |
| 4,278,000 | 7/1981 | Saito et al. | 84/1.16 |
| 4,290,331 | 9/1981 | Izdebski | 84/1.14 |
| 4,314,495 | 2/1982 | Baggs | 84/1.16 |
| 4,334,454 | 6/1982 | Wall | 84/299 |
| 4,378,721 | 4/1983 | Kaneko et al. | 84/1.14 |
| 4,425,832 | 1/1984 | Peavey | 84/298 |
| 4,657,114 | 4/1987 | Shaw | 84/1.16 |
| 5,208,410 | 5/1993 | Foley | 84/298 X |
| 5,347,905 | 9/1994 | Cipriani | 84/298 |

OTHER PUBLICATIONS

The Guitar Handbook, Denyer, 1982, p. 171.

*Primary Examiner*—William M. Shoop, Jr.
*Assistant Examiner*—Jeffrey W. Donels
*Attorney, Agent, or Firm*—Lucian Wayne Beavers

[57] ABSTRACT

An intonation adjustment system is provided for a stringed instrument. A saddle setup tool has a plurality of selectable, distinctly spaced intonation points so that a preferred one of the selectable, distinctly spaced intonation points can be determined for each string of the instrument. Then a bridge saddle is constructed from a set of prefabricated candidate saddle segments by selecting a group of selected saddle segments making up the instrument saddle and providing the desired combination of intonation points as determined with the saddle setup tool. A pickup for an amplified instrument provides adjustable positioning of individual piezo-electric transducer elements so that relative volume outputs of the strings may also be adjusted.

33 Claims, 4 Drawing Sheets

BRIDGE SADDLE WITH ADJUSTABLE INTONATION SYSTEM

This is a continuation of application Ser. No. 07/897,787 filed on Jun. 12, 1992, now abandoned.

BACKGROUND OF THE INVENTION

1. Field of the Invention

The present invention relates generally to apparatus and methods for adjusting the intonation of a stringed instrument such as a guitar and for adjusting the output of individual strings of a stringed instrument utilizing an electrical pickup.

2. Description of the Prior Art

Traditional steel string acoustic guitars employ a bridge saddle which is slanted, i.e., not perpendicular to the instrument's center line, to provide intonation compensation. The larger bass strings require a longer length between the nut and bridge of the guitar than do the smaller treble strings, due to their increased mass and stretching characteristics. In order to play in tune, the instrument must have a slanted bridge saddle.

In theory, this works well enough, assuming the manufacturer has placed the saddle position correctly. However, string length for correct intonation is dependent on several factors including the mass of the string, the core wire diameter of the string, the instrument's action height, and scale length, to name several.

It can readily be seen that, of these several variables, the scale length is set by the factory, as is the basic position of the saddle. If the manufacturer has positioned the saddle correctly based on a certain set of strings, and if the player always uses only those strings, at the factory action height positions, he may reasonably hope the guitar will play in tune. Quite often, of course, the guitar does not play satisfactorily in tune. This leads to repairs or modifications at custom guitar repair shops which alter the intonation of the individual strings by filing the top edge of the bridge saddle to move the location of the supporting point for the string. Since a typical bridge saddle is only 3/32 inch to 1/8 inch wide, this task is delicate and involved.

To accomplish such modifications, a skilled luthier will first confirm that the basic saddle location is correct, and that some additional work will permit him to accurately set the intonation for each string. He may then take a file and slightly flatten the top of the existing saddle. If the original saddle location is wrong, the luthier fills the saddle slot and cuts a new one.

The luthier will then typically determine the preferred intonation point for each string as follows. A short length of guitar string of approximately 0.020-inch diameter has a right angle bend placed therein approximately 1/4 inch from the end of the string. The luthier can then slip this 1/4-inch long by 0.020-inch diameter wire under the string which is to be adjusted. Although this minutely raises the action height of the string, it is not sufficient to be noticeable. The luthier moves this wire toward the front, i.e., the neck end, or back of the saddle and compares the harmonic at the twelfth fret with the fretted tone at that point. Moving the wire segment back increases the length of the string, and causes the fretted note to be flatter in pitch. Once the harmonic and fretted note agree, the luthier marks the saddle to indicate the correct location of the support point, and then moves his bent wire to the next string and repeats the process.

Once the preferred intonation points for all of the strings have been marked on the top surface of the saddle, the saddle is removed from the guitar and placed in a vise. The luthier then uses a small file to notch excess material away from the marked locations. When this task is completed, the saddle is replaced and the instrument is tuned. This is a time-consuming and expensive procedure.

Another feature of acoustic guitars which is problematic is the adjustment of volume of individual string output on guitars which have electric pickups for use with an amplifier. The type of pickup most commonly used with hollow-bodied acoustic guitars is one utilizing piezo-electric transducers. In conventional piezo-electric pickups, the spacing of the individual crystals or transducer elements is predetermined by the manufacturer. Unfortunately, this spacing rarely, if ever, coincides with the actual string spacing of the instrument. When this happens, it is quite likely that the string output of the instrument will be uneven. Today's players are not fond of this, and luthiers employ many time-consuming and frustrating tricks to equalize this output. In addition, the different angles of the strings across the top of the saddle, as well as their relative masses, may also cause the output to vary. The player may be forced to vary his string gauges to get equal output from his pickup.

Thus there is a need for a bridge saddle and pickup design which will allow easy adjustment of the intonation point of individual strings, and which will allow adjustment of the relative outputs of strings when utilized with an electric pickup. The present invention addresses each of these needs, both individually and in combination.

SUMMARY OF THE INVENTION

An intonation adjustment system for a stringed instrument having a plurality of strings and an instrument saddle supporting the strings includes a saddle setup tool having a plurality of selectable, distinctly spaced intonation points so that a preferred one of said selectable, distinctly spaced intonation points can be determined for each of the strings of the instrument.

The system further includes a set of prefabricated candidate saddle segments from which can be selected a group of selected saddle segments making up the instrument saddle and providing any possible combination of said selectable intonation points for said plurality of strings.

Preferably the group of selected saddle segments includes three selected saddle segments, each of which supports two of the strings. For a steel string guitar having an arcuate top profile on the instrument saddle, the group of three saddle segments will include two outside segments and one inside segment.

Thus, the set of prefabricated candidate saddle segments includes a first subset of candidate outside saddle segments and a second subset of candidate inside saddle segments.

Thus, the saddle setup tool can be used to quickly determine the preferred one of the selectable intonation points for each string, and then the prefabricated saddle segments can be selected having those preferred intonation points and the instrument can be quickly assembled having a customized saddle with individually selected intonation points for each string.

Additionally, for those guitars utilizing an electrical pickup for use with an amplifier, an improved pickup is provided for placement in the saddle slot of the instrument under the bridge saddle. The pickup includes a plurality of transducer elements, each of which is associated with one of the strings of the guitar, and each of which is movable relative to the other in a direction transverse to a length of the strings so that a volume output of the strings relative to each other may be adjusted.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
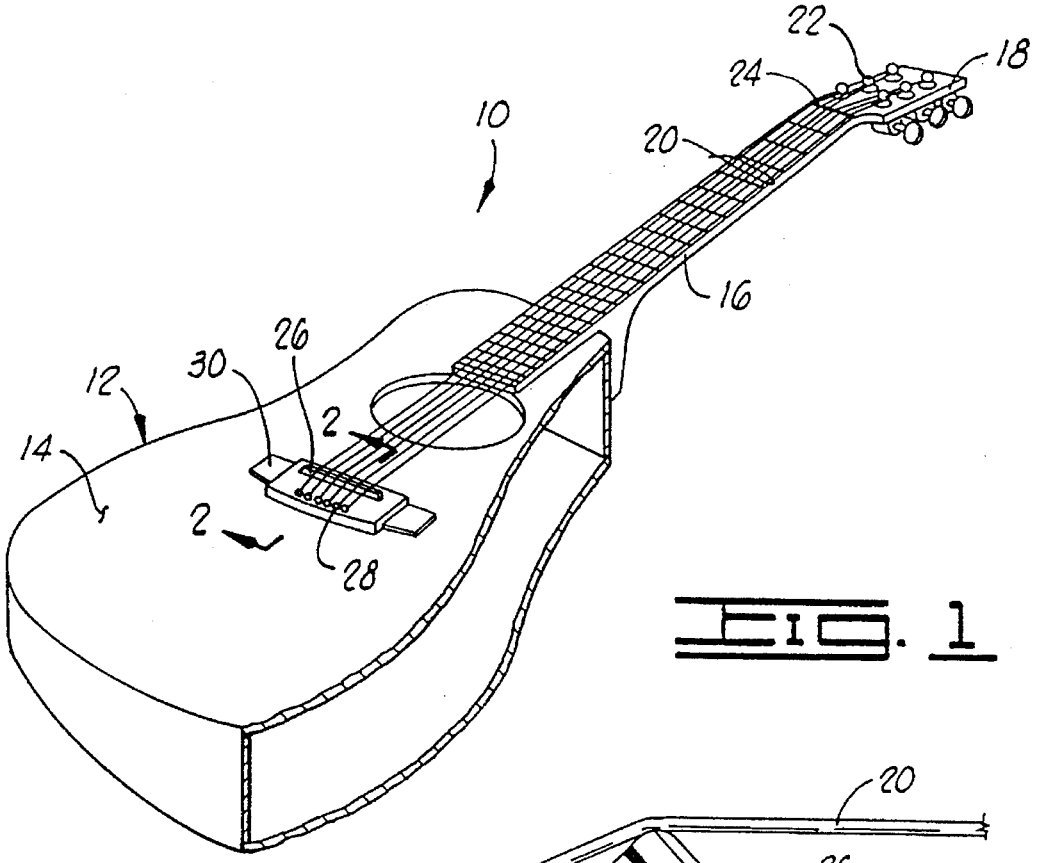
FIG. 1 is a perspective sectioned view of a hollow body, flat top acoustic guitar incorporating the bridge saddle and pickup of the present invention.

Referring now to the drawings and particularly to FIG. 1, a guitar incorporating the present invention is thereshown and generally designated by the numeral 10. The guitar 10 may be more generally referred to as a stringed instrument 10. The guitar 10 illustrated is a hollow bodied, acoustic guitar having a body generally designated by the numeral 12 with a flat top 14. The present invention may also be used with a solid body guitar where applicable. A neck 16 extends from the body 12 and terminates in a peghead 18. Six strings 20 are mounted on the body 12 and neck 16. Strings 20 are preferably steel strings. Each string at its forward end is attached to one of a plurality of tuning heads 22. The string extends over a forwardmost support piece generally referred to as a nut 24. The rearward portion of the strings are supported by a bridge saddle 26. The rear end of the strings are attached to bridge pins such as 28.

Figure 2:
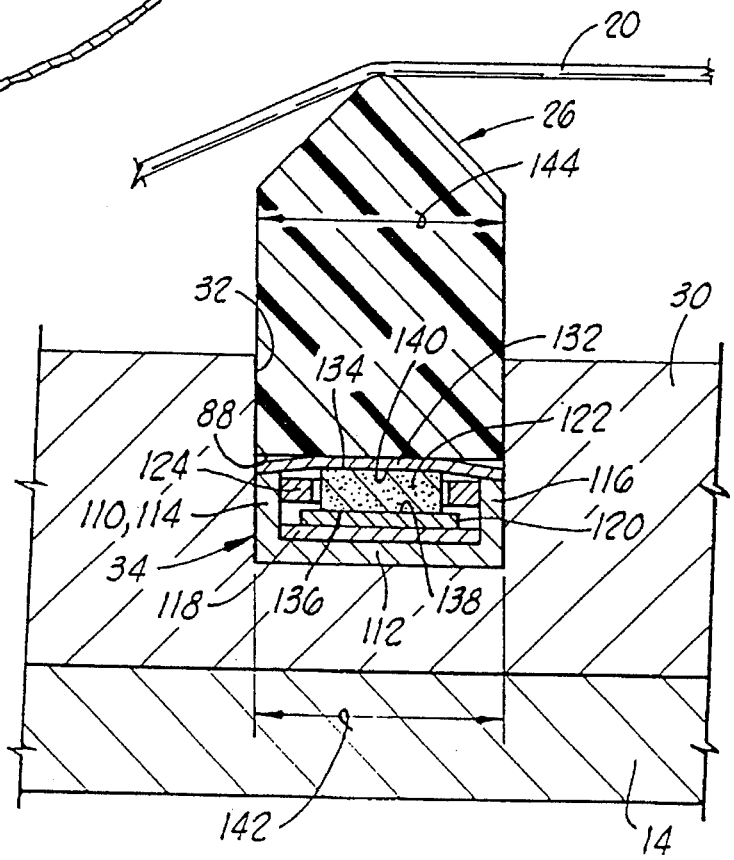
FIG. 2 is an enlarged cross-section view taken along line 2—2 of FIG. 1 showing the details of construction of the pickup and showing the placement of the pickup and bridge saddle within the saddle slot of the bridge.

The bridge saddle 26 is mounted in a bridge 30 which itself is rigidly attached to the top 14 of guitar body 12. As best seen in FIG. 2, the bridge 30 has a saddle slot 32 formed therein within which the bridge saddle 26 is received. If it is desired to amplify the output of the guitar, an electric pickup generally designated by the numeral 34 is placed in the saddle slot 32 beneath the bridge saddle 26 so that the vibrations of strings 20 are transmitted through the bridge saddle 26 to the electrical pickup 34 which transforms the physical vibrations into electrical signals which may then be amplified.

Figure 3:
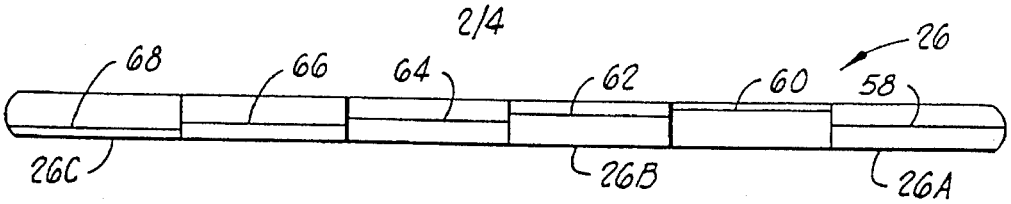
FIG. 3 is a plan view of a segmented bridge saddle having three segments each of which have individually selectable string intonation points for two strings.
Figure 4:
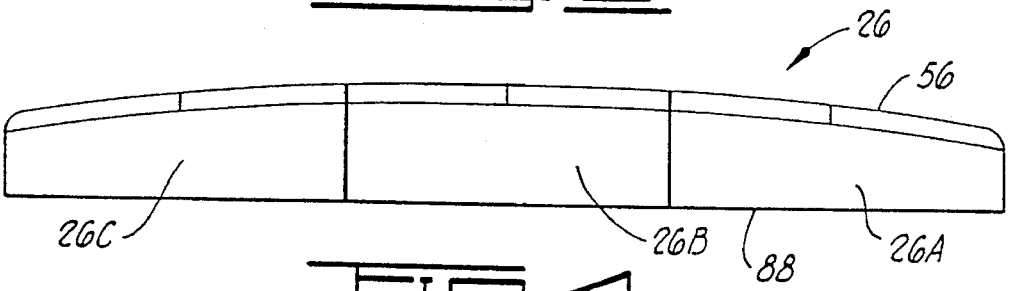
FIG. 4 is a back elevation view of the bridge saddle of FIG. 3.

The bridge saddle 26 is best seen in FIGS. 3 and 4. The bridge saddle 26 is preferably constructed of three saddle segments 26A, 26B and 26C. Each of the three saddle segments will support two of the strings 20.

In the embodiment illustrated, any one of five selectable, distinctly spaced intonation points can be selected for each of the strings 20. This is accomplished by providing a set of prefabricated candidate saddle segments from which can be selected the group of saddle segments 26A, 26B and 26C making up the instrument saddle 26 and providing any possible combination of said selectable intonation points for said plurality of strings.

Figure 8:
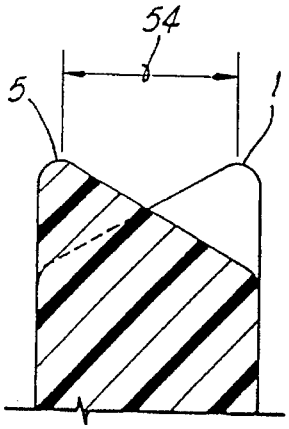
FIG. 8 is an elevation view of the upper end of a portion of a candidate saddle segment which shows in solid lines a supporting ridge in position 5, and which shows in phantom lines a supporting ridge in position 1.
Figure 9:
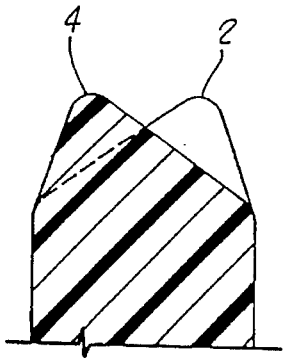
FIG. 9 is a view similar to FIG. 8 of another candidate saddle segment showing in solid lines a supporting ridge in position 4 and in phantom lines a supporting ridge in position 2.
Figure 10:
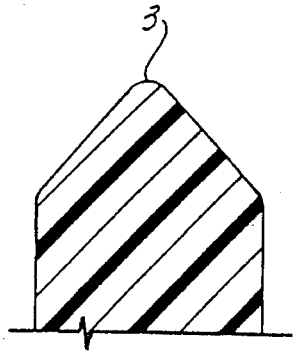
FIG. 10 is an elevation view of another candidate saddle segment showing a supporting ridge in position 3.

The five possible, distinctly spaced intonation points for each string are best illustrated with reference to FIGS. 8, 9 and 10 which represent the five possible intonation points which can be selected for each string from the set of prefabricated candidate saddle segments. FIGS. 8, 9 and 10 are taken along the same line as line 2—2 of FIG. 1 and thus are oriented like the bridge saddle 26 seen in FIG. 2. Thus, the solid lines in FIG. 8 show an intonation point or supporting ridge 5 which represents the rearwardmost intonation point, and in phantom lines FIG. 8 shows a forwardmost intonation point designated by the numeral 1.

Similarly, in FIG. 9, the solid lines illustrate intonation point 4 and the phantom lines illustrate intonation point 2. Finally, in FIG. 10, the centralmost intonation point designated by the numeral 3 is represented.

The saddle segments may be injection molded from a hard plastic material.

Figure 5:
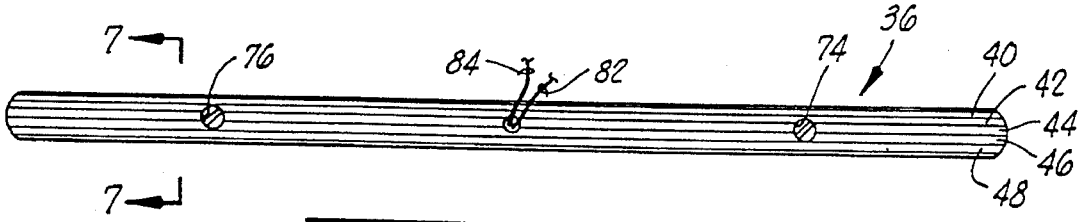
FIG. 5 is a plan view of a saddle setup tool utilized to select the preferred intonation point for each string.
Figure 6:
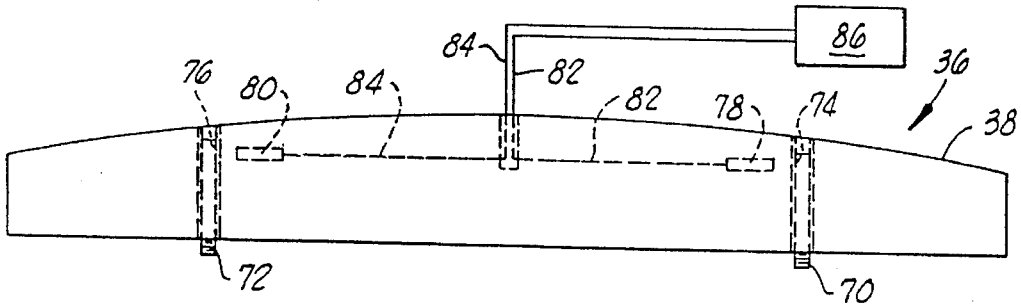
FIG. 6 is a back elevation view of the setup tool of FIG. 5.
Figure 7:
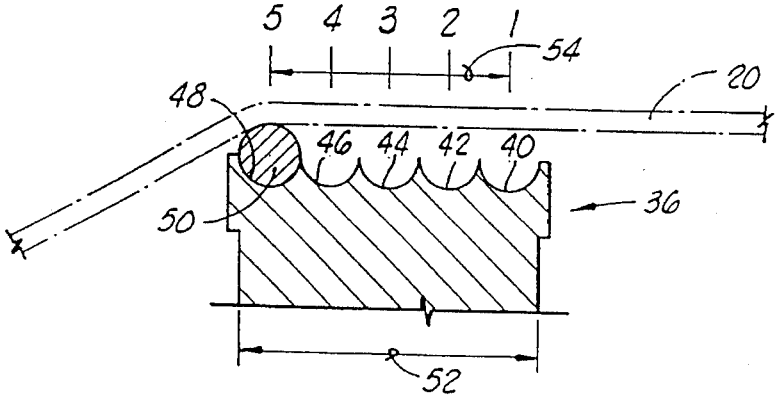
FIG. 7 is a section view taken along line 7—7 of FIG. 5 illustrating the five selectable intonation points for each guitar string.

FIGS. 5–7 illustrate a saddle setup tool 36 which is utilized to select the preferred intonation point 1, 2, 3, 4 or 5 for each string. The saddle setup tool 36 has a top surface 38 having five parallel spaced grooves 40, 42, 44, 46 35 and 48 defined therein. As seen in FIG. 7, a temporary movable ridge 50 may be placed in a selected one of the grooves 40–48 to support the string 20 while the intonation of the string is checked. The temporary movable ridge 50 may be formed from a piece of bent guitar string or wire having a diameter of approximately 0.020 inches.

As indicated in FIG. 7, the grooves 40–48 correspond to selectable supporting ridge positions 1–5, respectively. A saddle setup tool width 54 between positions 1 and 5 on the setup tool 36 is substantially equal to the saddle width 55 between positions 1 and 5 as illustrated in FIG. 8. Positions 1 and 5 may be referred to as a forward edge and a rearward edge, respectively, of the bridge saddle 26. Preferably the points 1 through 5 are equally spaced.

As seen in FIG. 4, the instrument saddle 26 has an arcuate top profile 56 which is matched by the arcuate top profile 38 of setup tool 36. Thus, in profile the saddle segments 26A and 26C are mirror images of each other and are different in profile from the saddle segment 26B. The saddle segment 26B can be referred to as an inside segment, and the saddle segments 26A and 26C can be referred to as outside saddle segments. It will be apparent that if a set of prefabricated candidate saddle segments is provided for the position 26A, that those same saddle segments can be utilized for the position 26C by simply reversing the same. Similarly, it will be apparent that the set of prefabricated saddle segments from which the inside segment 26B will be selected will be fewer in number since the inside segment 26B can be reversed to provide multiple alternative supporting ridge positions from a given saddle segment.

Thus, the set of prefabricated candidate saddle segments can be described as including a first subset of candidate outside saddle segments from which segments 26A and 26C will be selected, and a second subset of candidate inside saddle segments from which saddle segment 26B will be selected. The second subset is exclusive of the first subset, i.e., that is there are no common members between the first and second subsets.

For the disclosed preferred embodiment providing five selectable intonation points for each string, the first subset of candidate outside saddle segments must include twenty-five different candidate outside saddle segments, each having a different combination of two intonation points, to provide all possible combinations of supporting positions for two strings. The second subset of candidate inside saddle segments must include fifteen different candidate inside saddle segments, each having a different combination of two intonation points in order to provide all possible combinations of intonation points for the two strings supported by inside segment 26B. That this is so is shown by the following Table I which illustrates the positions provided by the fifteen different inside saddle segments in both their primary position and reverse position. It is seen that segments numbered 5, 9, 12, 14 and 15 provide duplicate positions when reversed, so that the fifteen segments provide a total of twenty-five different possible combinations of the five supporting positions for the two strings.

TABLE I

| Inside Segment No. | Primary Position | Reverse Position |
|---|---|---|
| 1 | 1-1 | 5-5 |
| 2 | 1-2 | 4-5 |
| 3 | 1-3 | 3-5 |
| 4 | 1-4 | 2-5 |
| 5 | 1-5 | 1-5 |
| 6 | 2-1 | 5-4 |
| 7 | 2-2 | 4-4 |
| 8 | 2-3 | 3-4 |
| 9 | 2-4 | 2-4 |
| 10 | 3-1 | 5-3 |
| 11 | 3-2 | 4-3 |
| 12 | 3-3 | 3-3 |
| 13 | 4-1 | 5-2 |
| 14 | 4-2 | 4-2 |
| 15 | 5-1 | 5-1 |

Thus, if for example a kit is provided including the set of prefabricated candidate saddle segments with one specimen of each possible combination needed for the segments 26A, 26B and 26C, that set will include twenty-five different candidate outside saddle segments and fifteen different candidate inside saddle segments. Additionally, it is desirable to include one or more blank inside saddle segments and one or more blank outside saddle segments to provide for the unlikely event that it is desired to custom construct a segment having a supporting ridge at a slightly different position than one of the five positions provided by the prefabricated segments, and also to provide for the unlikely event that the outside segments 26A and 26C require the same combination of supporting ridges.

It will be understood that the set of candidate saddle segments can of course include more than one specimen of each possible combination of two intonation points. For example, a kit for use by luthiers may be marketed including multiple copies of each different prefabricated candidate saddle segment along with a single setup tool 36 and a single jig 90. The luthier would use this kit to set up a large number of instruments and would gradually use up the collection of candidate saddle segments.

Thus in the particular bridge saddle 26 illustrated in FIG. 3, the right outside saddle segment 26A supports the first and second strings on supporting ridges 58 and 60 which are in the 3 and 1 positions, respectively. Inside saddle segment 26B supports the third and fourth strings on supporting ridges 62 and 64 which are in the 2 and 3 positions, respectively. Left outside saddle segment 26C includes supporting ridges 66 and 68 which support the fifth and sixth strings in the 4 and 5 positions, respectively.

Any desired combination of supporting ridges 58–68 with each ridge in any one of the positions 1–5 can be provided by simply selecting the appropriate prefabricated candidate saddle segments from the set of candidate saddle segments.

As illustrated in FIG. 6, the saddle setup tool 36 provides several other features which aid in setting up the guitar 10. First, the saddle setup tool 36 has first and second supporting screws 70 and 72 which are received in threaded bores 74 and 76 which extend vertically through the saddle setup tool 36. By rotating the support screws 70 and 72 with a screwdriver inserted downward through the bores 74 and 76, the action height of the setup tool 36 may be adjusted to determine a preferred action height for the instrument saddle 26. When using the support screws 70 and 72, a thin metal strip (not shown) should be placed in the bottom of saddle slot 32 to prevent screws 70 and 72 from digging into the wooden bridge 30.

A second unique feature of the saddle setup tool 36 is the provision of first and second piezo-electric transducers 78 and 80 which are imbedded in the setup tool 38 and from which electrical leads 82 and 84 extend to an electronic tuner 86. Thus, when selecting the preferred intonation point for each string, the electronic tuner 86 will represent the frequency of vibrations generated when the string is struck so that the harmonic at the twelfth fret can be compared to the fretted tone at that point by comparison of readings on the electronic tuner 86. Of course, the selection of the preferred intonation point can also be done by ear.

The setup tool 36 may be molded from plastic material with the piezo-electric crystals 78 and 80 with their lead wires 82 and 84 imbedded therein at the time of molding.

After the saddle segments 26A, 26B and 26C have been selected to provide the preferred intonation point for each string, and after the desired action height has been selected through use of the adjustable support screws 70 and 72, it may be necessary to grind off the bottom edge 88 of the segments making up bridge saddle 26 so as to provide the bridge saddle 26 with the desired action height.

Figure 11:
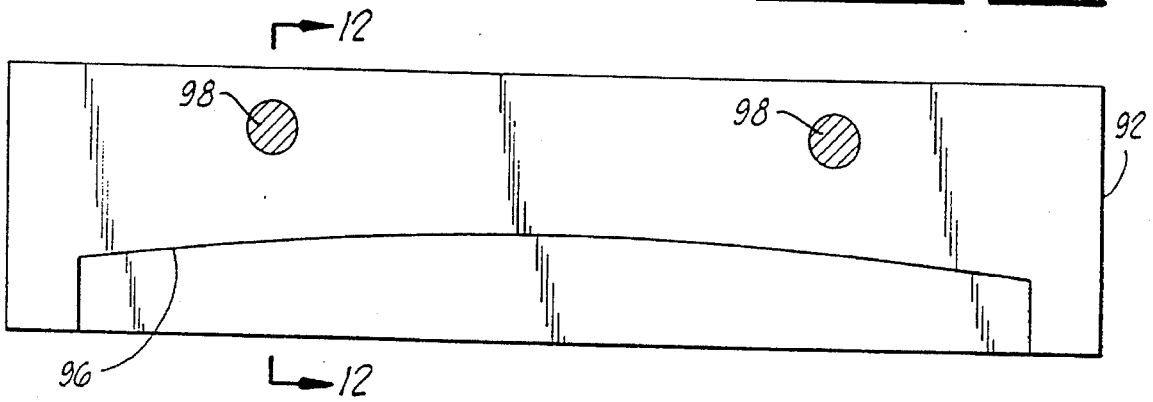
FIG. 11 is an elevation view of a female portion of a jig assembly for holding the saddle segments together while filing off the lower edges thereof to adjust an intonation height of the bridge saddle. The view of FIG. 11 is taken along line 11—11 of FIG. 12.
Figure 12:
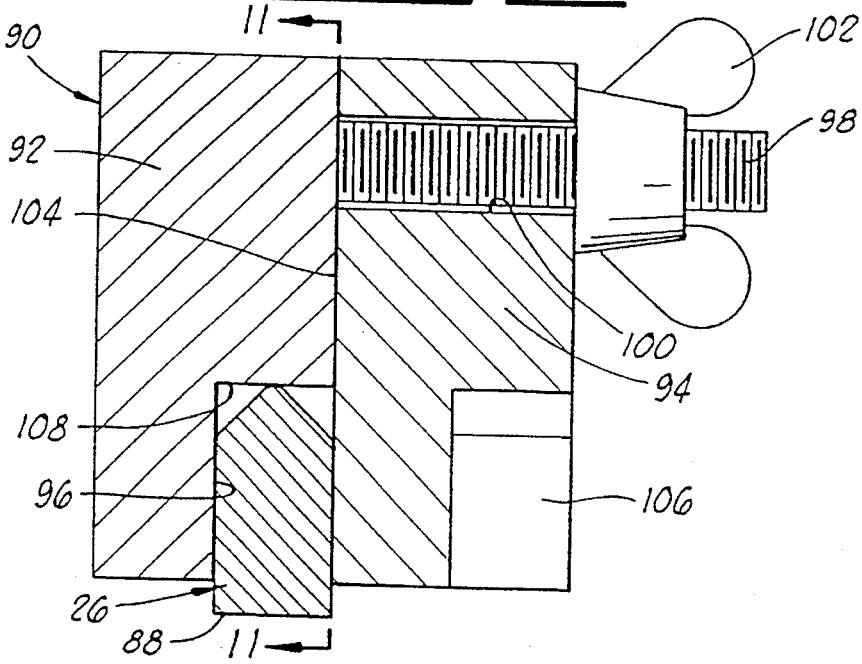
FIG. 12 is an elevation sectioned view taken along line 12—12 of FIG. 11 showing the assembled jig assembly with a segmented bridge saddle held in place therein.

FIGS. 11 and 12 illustrate a jig generally designated by the numeral 90 which is constructed to hold the saddle segments while their bottom edges 88 are ground off as desired.

The jig 90 includes first and second jig portions 92 and 94. First jig portion 92 has a recess 96 defined therein which is shaped to receive and hold the group of selected saddle segments 26A, 26B and 26C in position relative to each other, analogous to the positions of FIG. 4, while material is removed from their lower edge 88 to adjust an action height thereof.

A pair of threaded studs 98 extend from first jig portion 90 through bores 100 in second jig portion 94. A wing nut 102 is received on each stud 98. The second jig portion 94 has a flat surface 104 facing the recess 96. The bridge saddle 26 when placed in the recess 96 can be clamped and held therein by tightening down on the wing nuts 102.

The second jig portion 94 has a recess 106 defined therein which is shaped substantially identically to the recess 96. The setup tool 36 may be placed in the recess 106 so that the desired location of bottom edge 88 may be easily marked on the saddle segments 26A, 26B and 26C.

It is anticipated that in the normal situation the desired action height will be determined only once and the same action height will be utilized for all saddle segments 26A, 26B and 26C. It is possible, however, to reset the action height for each saddle segment 26A, 26B or 26C. Shims (not shown) may be placed between a top surface 108 of recess 96 and the top edge 56 of one or more saddle segments 26A, 26B or 26C so as to adjust the relative action heights of the individual saddle segments 26A, 26B and 26C prior to grinding off their lower edges to provide a straight lower edge 88 for the entire assembly. By this means, it is possible to accommodate fingerboards with different top radii than the standard one supplied with this system.

Pickup Construction

Figure 13:
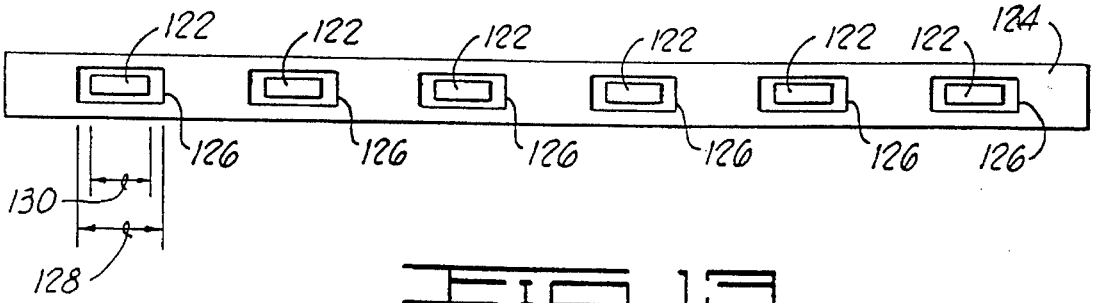
FIG. 13 is a plan view of an insulating strip utilized with the pickup of FIG. 2

Turning now to FIGS. 2 and 13, the details of construction of pickup 34 will be described.

The pickup 34 includes an electrically conductive channel 110 having a bottom 112 and first and second flanges 114 and 116 extending upward from opposite edges of bottom 112. A layer 118 of insulating material covers the bottom 112 of channel 110. A first conductor means 120 lies on top of the insulating material 118. Six piezo-electric transducer elements 122 lie on top of first conductor means 120. Each of the piezo-electric transducer elements 122 lies below a respective one of the strings 20.

A strip 124 of insulating material having a plurality of openings 126 has the six transducer elements 122 each received within a respective one of the openings 126 as best seen in FIG. 13. FIG. 13 is a plan view of only the strip 124 with the piezo-electric crystals 122 positioned therein. As seen in FIG. 2, the strip of insulating material 124 has a vertical thickness less than a thickness of the piezo-electric transducer elements 122 as defined between their top and bottom poles 134 and 136. Thus, the insulating strip 124 will not interfere with the forces transmitted across the piezo-electric transducer elements 122.

As seen in FIG. 13, each of the openings 126 has a lateral dimension 128 transverse to the length of strings 20 which lateral dimension is greater than a lateral width 130 of the transducer elements 122. Thus, the lateral dimension 128 of each opening 126 defines a zone of lateral movability of its associated transducer element 122.

A second conductor means 132 lies on top of the transducer elements 122.

Each of the piezo-electric transducer elements 122 can be described as having top and bottom poles 134 and 136 of opposite polarity. The first conductor means 120 is in electrically conductive contact with the bottom poles of each of the plurality of piezo-electric transducer elements 122. The second conductor means 132 is in electrically conductive contact with the top poles 134 of each of the plurality of piezo-electric transducer elements 122.

Each of the piezo-electric transducer elements 122 is movable laterally in a direction transverse to the length of strings 20 so that a relative volume output of its associated string 20 relative to the others of the strings 20 may be adjusted. It will be appreciated that the more nearly directly below its associated string that a given transducer element 122 is located, the stronger the electrical signal generated by that transducer element will be for a given physical vibration of the string. Thus, by moving a given transducer element 122 laterally away from a position directly below its associated string, the relative electrical output generated for that string will be reduced.

Preferably, the first conductor 120 is a first common conductor 120 which electrically connects all of the bottom poles 136 of the plurality of transducer elements 122, and the second conductor means 132 is a second common conductor means 132 which electrically connects all of the top poles 134 of the plurality of transducer elements 122. It will be appreciated, however, that it is possible to use first and second conductor means 120 and 132 which provide individual electrical contacts with each transducer element 122 so that the electrical outputs of the six transducer elements 122 are isolated from each other.

In order to aid in holding the piezo-electrical transducer elements 122 in their chosen positions sandwiched between the first and second conductor means 120 and 132, it is preferably that at least one of the first and second conductor means 120 and 132 include a tacky conductive adhesive upper or lower surface 138 or 140, respectively, in electrically conductive contact with the transducer elements 122 in order to hold the transducer elements 122 in place relative to the first and second conductors 120 and 132. The tacky conductive adhesive surface 138 and/or 140 is capable of being repeatedly removed from contact with the plurality of transducer elements 122 so that a position of one or more of the elements 122 relative to the conductor means 120 and 132 can be adjusted, and then the tacky conducting adhesive will again be engaged with the transducer element 122 when the pickup is reassembled as shown in FIG. 2. Materials suitable for use as the tacky conductive adhesive referred to herein include 3M #1181 copper foil with conductive adhesive (available from the 3M Company) which has been heat-treated to reduce its surface tack. This could be done by placing a roll of the tape in an oven at 65° C. (120° F.) for approximately twelve hours.

As is seen in FIG. 2, the second conductor 132 overlies and engages the top edges of first and second flanges 114 and 116 of channel 110. The second conductor 132, using the tacky adhesive described above, may in fact wrap around the flanges 114 and 116 and the transverse ends of the channel 110 as an easy means to secure the second conductor 132 to channel 110. Thus, the electrically conductive channel 110 and the second conductor means 132 provide a conductive cage surrounding the transducer elements 122. The cage will typically be grounded so as to provide a shield against electrical interference from outside sources with the electrical signals generated by the piezo-electric transducer elements 122.

Preferably, alternating ones of the six piezo-electric transducer elements 122 are polarized in an opposite manner. For example, the leftmost transducer element 122 in FIG. 13 may have a positive top pole and a negative bottom pole, while the transducer element 122 to the right thereof will have a negative top pole and a positive bottom pole, and so forth. With this arrangement extraneous forces such as pressure from the palm of a hand applied across the entire bridge saddle 26, will be out of phase in the alternating transducers and thus the signals generated by the individual transducers will cancel each other. This reduces noise and improves fidelity of the output from the pickup.

In the embodiment of FIG. 2, the channel 110 has an outside width 142 defined between outside surfaces of the first and second flanges 114 and 116. The piezo-electric transducer elements 122 extend higher than the upper edges of the first and second flanges 114 and 116. The second conductor means 132 is a separate element from the bridge saddle 26 itself, and the bridge saddle 26 has a saddle width 144 at least as great as the outside width 142 of channel 110. Thus, the bottom edge 88 of bridge saddle 26 is in load-bearing engagement through the second conductor means 132 with the piezo-electric transducer elements 122. Thus the downward forces transmitted by strings 20 to the bridge saddle 26 are transmitted through the piezo-electric transducer elements 122 to the bridge 30 and to the top 14 of guitar body 12. Those vibrational forces cause a corresponding varying electrical output from the transducer elements 122, which electrical outputs are picked up by first and second conductor means 120 and 132 and carried by leads (not shown) to a conventional amplifier (not shown).

The use of a segmented bridge saddle 26 insures maximum pressure and output from each crystal as compared to a single unsegmented bridge saddle.

In a preferred embodiment of the pickup 34, the channel 110 is constructed of brass with the bottom 112 and flanges 114 having thicknesses of 0.010 inch. The insulating layer 118 is constructed of material commonly referred to as fish paper and having a thickness of 0.005 inch. The first conductor means 120 is a strip of copper foil having a thickness of 0.005 inch. The piezo-electric transducer elements have a vertical thickness of 0.020 inch. The second conductor means 132 is another strip of copper foil having a thickness of 0.005 inch with conductive adhesive on the bottom surface thereof. Thus the total vertical height of pickup 34 in this preferred embodiment is 0.045 inch. The insulating strip 124 has a thickness of 0.010 inch. With reference to FIG. 13, the lateral dimension 128 of opening 126 is 0.250 inch, and the lateral width 130 of transducer element 122 is 0.125 inch thus providing room for 0.125 inch lateral movement of each transducer element 122. Typical width of elements 122 in a direction parallel to the strings is 0.065 inch.

When it is desired to adjust the relative volume output of one or more of the strings 20 relative to the other strings, this can be readily accomplished by separating the first and second conductor means 120 and 132 and then moving at least one of the piezo-electric transducer elements 122 to a new position relative to the first and second conductor means and then reassembling the pickup 34 so that the piezo-electric transducer elements 122 are held in their new positions between the first and second conductor means 120 and 132.

Although the preferred embodiment disclosed herein has a separate piezo-electric transducer element associated with each string, it will be understood that one transducer element could be associated with more than one string. For example, each transducer element could be associated with a pair of strings. This would be especially applicable to a twelve-string guitar which preferably would have six transducer elements, each of which would underlie a pair of strings.

It will be readily apparent that by combining the intonation adjustment system described herein with the pickup having adjustable position transducer elements described herein that a guitar is provided which can be uniquely and easily customized and adjusted to provide a desired sound for the individual guitar player.

Both the intonation adjustment and the adjustable piezos may be utilized in original equipment manufacture or may be utilized to retrofit existing instruments.

Figure 14:
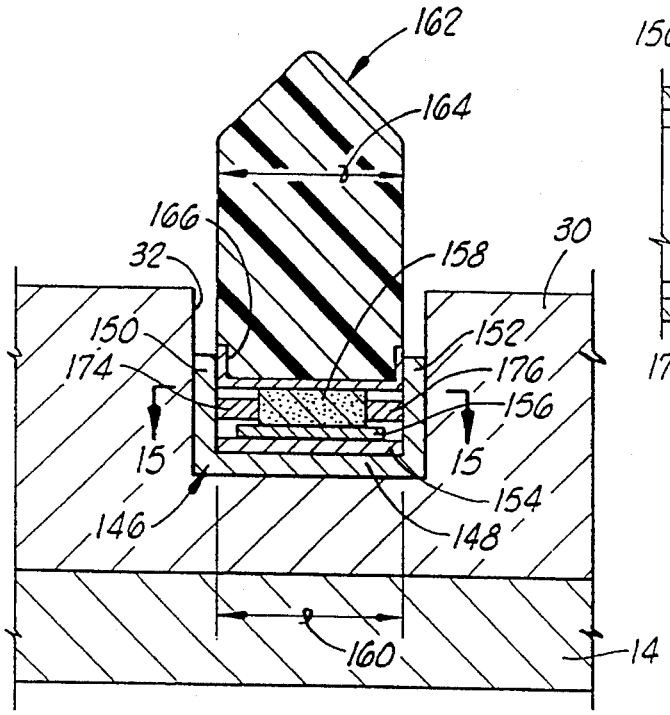
FIG. 14 is a view similar to FIG. 2 showing an alternative embodiment of the pickup.
Figure 15:
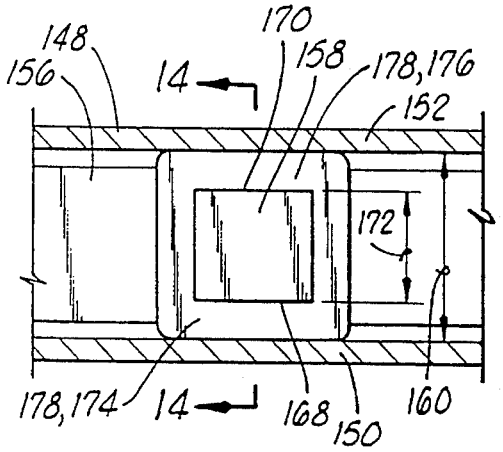
FIG. 15 is a plan view taken along line 15—15 of FIG. 4 showing details of the alternative pickup of FIG. 14.

Alternative Embodiment of FIGS. 14 and 15

FIGS. 14 and 15 illustrate an alternative design of the pickup which is designated generally by the numeral 146. The pickup 146 includes a channel 148 having first and second flanges 150 and 152. An insulating layer 154 overlies the bottom of channel 148. A first conductor means 156 overlies insulating layer 154. A plurality of piezo-electric transducer elements 158 lie on top of first conductor means 156.

As is apparent in FIG. 14, the top edges of first and second flanges 150 and 152 extend higher than the piezo-electric transducer elements 158. The channel 148 has an inside width 160 defined between inside surfaces of the first and second flanges 150 and 152.

A modified bridge saddle 162 has a narrower saddle width 164, as compared to saddle 26 of FIG. 2, so that the lower portion of bridge saddle 162 is received between the inside surfaces of first and second flanges 150 and 152.

A second conductor means 164 is provided by a layer of conductive material which is formed on the bottom portion and lower side portions of bridge saddle 162. The second conductor means 166 engages the top surface of the piezo-electric transducer elements 158 and is also in electrical contact with the inside surfaces of the upper portions of first and second flanges 150 and 152 so that the second conductor means 166 and channel 148 provide a conductive cage surrounding the transducer elements 158.

As is best seen in the plan view of FIG. 15, the transducer elements 158 are substantially square in shape and have first and second opposite edges 168 and 170, respectively, nearest to the first and second flanges 150 and 152, respectively. The transducer elements 158 each have an element width 172 defined between first and second edges 168 and 170, with the element width 172 being less than the inside width 160 of channel 148.

The pickup 146 further includes first and second electrically insulating separators 174 and 176 located between the first and second edges 168 and 170 and the inside surfaces of first and second flanges 150 and 152, respectively. The separators 174 and 176 engage the inside surfaces of flanges 150 and 152, respectively, and engage the first and second edges 168 and 170, respectively, so that the transducer element 158 is snugly held between flanges 150 and 152.

Preferably, the first and second electrically insulating separators 174 and 176 are opposite sides of a four-sided insulating frame 178 surrounding the transducer element 158. A separate frame such as 178 surrounds each of the transducer elements 158, and the transducer elements 158 are laterally movable along the entire length of channel 148. Thus, the zone of possible positioning of each transducer element 158 is defined simply by the positions of the transducer elements on either side thereof.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. An intonation adjustment system for a stringed instrument having a plurality of strings and an instrument saddle supporting the strings, said instrument saddle having a saddle slot therein, said saddle slot having a width parallel to a length of said strings, said system comprising:

a saddle setup tool having a definite number of selectable distinctly spaced intonation points within said width of said saddle slot so that a preferred one of said selectable distinctly spaced intonation points can be determined for each of said strings of said instrument.

2. The system of claim 1, further comprising:

a set of prefabricated candidate fixed saddle segments adapted to be fixedly received in said saddle slot from which can be selected a group of selected saddle segments making up said instrument saddle and providing any possible combination of said definite number of selectable intonation points across said width of said saddle slot for said plurality of strings.

3. The system of claim 2, said plurality of strings being six strings, wherein:

said group of selected saddle segments includes three selected saddle segments each of which supports two of said strings.

4. The system of claim 3, wherein:

said instrument saddle has an arcuate top profile transverse to said strings, said group of three selected saddle segments including two outside segments and one inside segment.

5. The system of claim 4, wherein:

said set of prefabricated candidate saddle segments includes:

a first subset of candidate outside saddle segments; and a second subset of candidate inside saddle segments, said second subset being exclusive of said first subset so that no member of said second subset is identical to any member of said first subset.

6. The system of claim 5, wherein:

said definite number of selectable distinctly spaced intonation points includes five and only five intonation points;

said first subset of candidate outside saddle segments includes twenty-five different candidate outside saddle segments each having a different combination of two intonation points; and said second subset of candidate inside saddle segments includes fifteen different candidate inside saddle segments each having a different combination of two intonation points.

7. The system of claim 1, wherein:

said saddle setup tool has an adjustable height support.

8. The system of claim 1, wherein:

said saddle setup tool includes a piezo-electric pickup having output leads for connection of said pickup to an electronic tuner.

9. The system of claim 1, wherein:

said saddle setup tool has a top surface having a plurality of parallel spaced grooves defined therein; and said saddle setup tool includes a movable temporary ridge constructed to be received in any one of said grooves.

10. The system of claim 9, wherein said grooves are equally spaced.

11. The system of claim 9, wherein said plurality of grooves includes at least five grooves.

12. An intonation adjustment system for a stringed instrument having a plurality of strings and an instrument saddle supporting the strings, said instrument saddle having a saddle slot therein having a slot width parallel to a length of said string, said system comprising:

a set of prefabricated candidate fixed saddle segments adapted to be received in said saddle slot from which can be selected a group of selected saddle segments making up said instrument saddle and providing any possible combination of selected intonation points from a definite number of available intonation points spaced across and within said slot width for each of said strings, at least one of said selected saddle segments supporting at least two of said strings.

13. The system of claim 12, said plurality of strings being six strings, wherein:

said group of selected saddle segments includes three selected saddle segments, each of which supports two of said strings.

14. The system of claim 13, wherein:

said instrument saddle has an arcuate top profile transverse to said strings, said group of three selected saddle segments including two outside segments and one inside segment.

15. The system of claim 14, wherein:

said set of prefabricated candidate saddle segments includes:

a first subset of candidate outside saddle segments; and a second subset of candidate inside saddle segments, said second subset being exclusive of said first subset so that no member of said second subset is identical to any member of said first subset.

16. The system of claim 12, wherein said plurality of available intonation points includes at least five available intonation points for each of said strings.

17. A method of setting an intonation of a stringed instrument having a plurality of strings supported by an instrument saddle, said saddle having a saddle slot with a slot width parallel to a length of said strings, comprising:

(a) determining for each of said strings which one intonation point of a plurality of selectable distinctly spaced intonation points on said saddle across and within said slot width provides an intonation test pitch closest to perfect intonation; and (b) assembling said instrument saddle from a group of saddle segments providing said one intonation point for each of said strings, at least one of said saddle segments of said group supporting at least two of said strings, said saddle segments being fixedly received in said saddle slot.

18. A method of setting an intonation of a stringed instrument having a plurality of strings supported by an instrument saddle, said saddle having a saddle slot with a slot width parallel to a length of said strings, comprising:

(a) determining for each of said strings which one intonation point of a plurality of selectable distinctly spaced intonation points on said saddle across said slot width provides a most nearly perfect intonation; and (b) assembling said instrument saddle from a group of saddle segments providing said one intonation point for each of said strings, at least one of said saddle segments of said group supporting at least two of said strings, said saddle segments being received in said saddle slot.

19. The method of claim 18, said plurality of strings being six strings, wherein said group of saddle segments includes three saddle segments each of which supports two of said strings.

20. The method of claim 19, wherein said instrument saddle has an arcuate top profile transverse to said strings and said three saddle segments include two outside segments and one inside segment.

21. The method of claim 18, further comprising:

after step (a) and before step (b), selecting said group of saddle segments from a set of prefabricated candidate saddle segments providing any possible combination of said selectable distinctly spaced intonation points for said plurality of strings.

22. The method of claim 21, said plurality of strings being six strings, wherein:

said group of prefabricated saddle segments includes three prefabricated saddle segments each of which supports two of said strings; and said set of prefabricated candidate saddle segments includes:

a first subset of candidate outside saddle segments; and a second subset of candidate inside saddle segments.

23. The method of claim 22, wherein said instrument saddle has an arcuate top profile transverse to said strings, and said second subset is exclusive of said first subset.

24. The method of claim 17, wherein said step (a) is performed with a saddle setup tool having said plurality of selectable distinctly spaced intonation points defined across a saddle setup tool width equal to an instrument saddle width.

25. The method of claim 18, wherein said step (a) is performed with a saddle setup tool having said plurality of selectable distinctly spaced intonation points defined across a saddle setup tool width substantially equal to an instrument saddle width.

26. A stringed instrument, comprising:

a body having a top;

a bridge mounted on said top of said body, said bridge having a saddle slot formed therein, said slot having a slot width;

a neck extending from said body;

a laureled of strings mounted on said body and neck and extending parallel to said slot width;

a saddle received in said saddle slot and supporting said plurality of strings, said saddle including a group of saddle segments fixedly received in said saddle slot at least one of which supports at least two of said strings, said group of saddle segments having a plurality of supporting ridges defined thereon, one of which supporting ridges engages each of said strings within said slot width, each of said supporting ridges being located to provide an intonation test pitch closest to perfect intonation for its respective string out of a plurality of selectable intonation point locations distinctly spaced across said slot width.

27. A stringed instrument, comprising:

a body having a top;

a bridge mounted on said top of said body, said bridge having a saddle slot formed therein, said slot having a slot width;

a neck extending from said body;

a plurality of strings mounted on said body and neck and extending parallel to said slot width;

a saddle received in said saddle slot and supporting said plurality of strings, said saddle including a group of saddle segments at least one of which supports at least two of said strings, said group of saddle segments having a plurality of supporting ridges defined thereon, one of which supporting ridges engages each of said strings, each of said supporting ridges being located to provide a most nearly perfect intonation for its respective string out of a plurality of selectable intonation point locations distinctly spaced across said slot width.

28. The stringed instrument of claim 27, wherein:

said plurality of strings includes six strings; and said group of saddle segments includes three saddle segments each of which supports two of said strings.

29. The stringed instrument of claim 28, wherein:

said saddle has an arcuate top profile transverse to said strings and said three saddle segments include two outside segments having identical top profiles and one inside segment.

30. The stringed instrument of claim 27, wherein said instrument is a guitar.

31. The stringed instrument of claim 30, wherein said guitar is a flat top acoustic guitar.

32. The stringed instrument of claim 31, wherein said strings are steel strings.

33. The stringed instrument of claim 27, wherein said plurality of possible distinctly spaced intonation point locations includes five equally spaced locations the outermost two locations of which are a forward edge of said saddle and a rearward edge of said saddle.

* * * * *